US006666161B1

(12) United States Patent
Cannon et al.

(10) Patent No.: US 6,666,161 B1
(45) Date of Patent: Dec. 23, 2003

(54) DELUXE FLOAT IN PLACE RAFT

(76) Inventors: Sandra R. Cannon, 1659 Rosetine St., Cocoa, FL (US) 32926; Roar L. Johannessen, 1659 Rosetine St., Cocoa, FL (US) 32926

( * ) Notice: Subject to any disclaimer, the term of this patent is extended or adjusted under 35 U.S.C. 154(b) by 0 days.

(21) Appl. No.: 09/604,052

(22) Filed: Jul. 15, 1999

Related U.S. Application Data

(60) Provisional application No. 60/143,939, filed on Jul. 15, 1999.

(51) Int. Cl.[7] ..... B63H 21/24
(52) U.S. Cl. ..... 114/294
(58) Field of Search ..... 114/294, 300

(56) References Cited

U.S. PATENT DOCUMENTS 2,546,396 A 3/1951 Jenkins
3,014,723 A * 12/1961 Butler ..... 273/350
3,336,613 A 8/1967 Wales
4,775,346 A * 10/1988 Gunter et al. ..... 441/129
4,913,672 A * 4/1990 Martin ..... 441/40
4,936,804 A * 6/1990 Dowdeswell ..... 441/6
5,342,229 A 8/1994 Whitt
5,410,981 A * 5/1995 Gutstein et al. ..... 114/294
5,853,309 A 12/1998 Biggs

* cited by examiner

*Primary Examiner*—Sherman Basinger
(74) *Attorney, Agent, or Firm*—Patent & Trademark Services; Joseph H. McGlynn

(57) ABSTRACT

A raft which has an anchoring system which holds the raft in position in a swimming pool, and which also has a securing portion for holding an anchor.

10 Claims, 1 Drawing Sheet

DELUXE FLOAT IN PLACE RAFT

This application claims the benefit of U.S. Provisional Ser. No. 60/143,939, filed Jul. 15, 1999.

BACKGROUND OF THE INVENTION

This invention relates, in general, to rafts, and, in particular, to a raft with an anchoring system.

DESCRIPTION OF THE INVENTION

In the prior art various types of rafts have been proposed. For example, U.S. Pat. No. 2,546,396 to Jenkins discloses a life raft which has securing means at opposite ends of the raft.

U.S. Pat. No. 3,336,613 to Wales discloses a life raft which has securing means at opposite ends of the raft.

U.S. Pat. No. 5,342,229 to Whitt discloses an anchor for a float that is attached to the float by a line which surrounds a portion of the float.

U.S. Pat. No. 5,853,309 to Riggs discloses a securing system for a float in a swimming pool.

SUMMARY OF THE INVENTION

The present invention is directed to a raft which has an anchoring system which holds the raft in position in a swimming pool, and which also has a securing portion for holding an anchor.

It is an object of the present invention to provide a new and improved anchoring system for a raft.

It is an object of the present invention to provide a new and improved anchoring system for a raft which can be used with virtually any type of pool.

It is an object of the present invention to provide a new and improved anchoring system for a raft which is inexpensive and easily assembled.

These and other objects and advantages of the present invention will be fully apparent from the following description, when taken in connection with the annexed drawings.

DESCRIPTION OF THE PREFERRED EMBODIMENT

Figure 1:
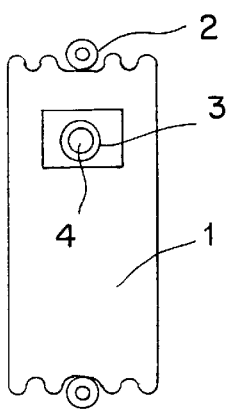
FIG. 1 is a top view of a raft with the anchor of the present invention stored in place on the raft.
Figure 4:
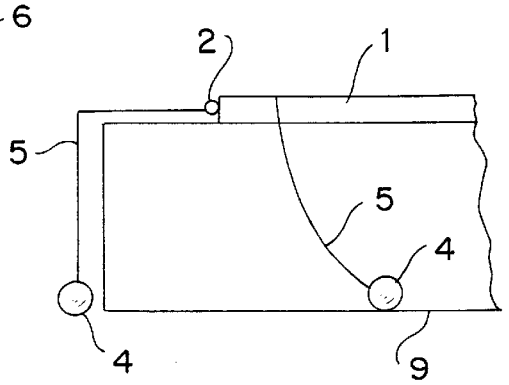
FIG. 4 is a side view of the anchor system of the present invention showing the float anchored in an above ground pool.
Figure 5:
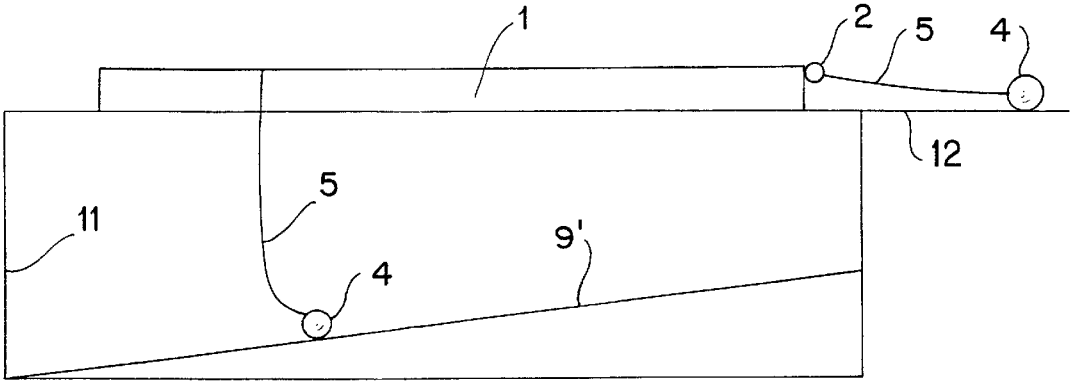
FIG. 5 is a side view of the anchor system of the present invention showing the float anchored in a pool with a sloping bottom.

Referring now to the drawings in greater detail, FIG. 1 shows a raft 1, which can be made from any conventional material and have any conventional shape utilized for floating pool rafts. The raft 1 has a pair of anchoring rings 2, although more than two rings can be used if desired. The rings will be used to secure the anchor 4 as will be described in more detail below. Positioned at one end of the raft 1 is a depression 3 which holds a weight 4 which, as will be described below, will anchor the raft 1 in position in a pool as shown in FIGS. 4 and 5. It should be noted that while only one depression and only one anchor are shown in FIG. 1, this is merely for illustrational purposes and multiple depressions that will hold multiple anchors can be used.

Figure 2:
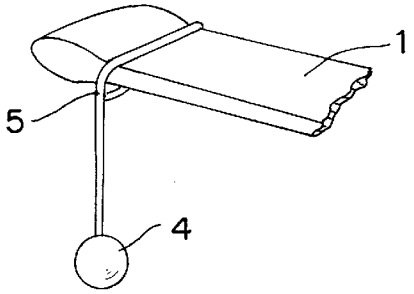
FIG. 2 is a partial perspective view of the present invention with the anchor secured around the raft in the in use position.
Figure 3:
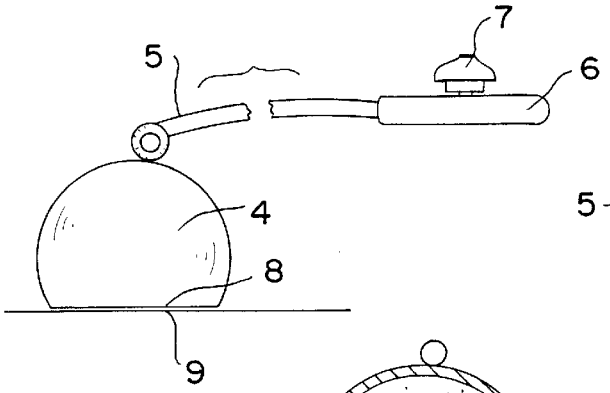
FIG. 3 is a side view of the anchor of the present invention showing the float on the end of the anchoring strap.

As shown in FIG. 2, the anchor weight 4 is attached to the raft 1 by means of a strap or ribbon 5. The strap 5 is attached, at one end, to a ring, similar to the rings 2 on the raft, as shown in FIG. 1. The other end of the strap 5 has a float 6, as shown in FIG. 3. The float 6 is hollow and has a closure member 7 which can be removed from an opening in the float to allow access to the interior of the float. The closure member 7 is secured in the opening by a friction fit, although other methods can be used without departing from the scope of the invention.

Removing the closure member will allow a user to empty water which might make its way into the float. The float 6 will prevent the end of the strap from sinking, thereby making it hard to retrieve the strap from the bottom of the pool in order to attach the strap to the raft.

The strap, as shown in FIG. 2, can be secured to the raft by wrapping the strap tightly around the float or raft 1. The preferred method of securing the strap is to have one half of a hook and loop fastener, such as VELCRO, secured along one entire side of the strap. The other side of the strap would have the mating half of the hook and loop fastener secured at intervals. In order to secure the anchor weight 4 to the raft, the strap would be wrapped tightly around the float 1 and the hook and loop fasteners would be secured in the normal manner. It should be noted that while hook and loop fasteners are the preferred means for securing the strap to the float, other fastening means can be used without departing from the scope of the invention. However, the hook and loop is preferred since this type of fastening means is automatically adjustable to fit different sizes of floats.

Figure 6:
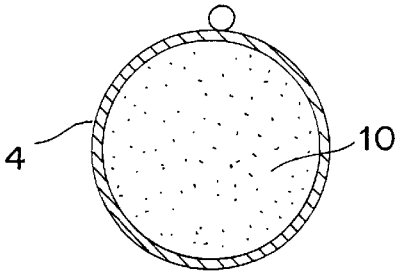
FIG. 6 is a cross-sectional view of the anchor of the present invention.

The anchor weight 4 is shown in FIG. 6 and comprises an outer covering which is rubber coated and malleable to conform to the surface it is placed on, as shown in FIG. 3 at 8. The hollow interior of the weight 4 can be filled with any material 10 that will add weight to the anchor such as, but not limited to, sand or metal pellets.

FIG. 4 shows how the anchoring system of the present invention can be used to secure the float 1 in position in an above ground pool with a floor 9. One of the anchors 4 can be secured around the float 1 by the strap 5 as described above. The anchor 4 will be allowed to rest on the floor 9 of the pool where the soft, malleable outer covering will conform to the bottom of the pool 9, as shown in FIG. 3. The malleable outer covering is important in a pool with a vinyl liner, such as an above ground pool, so the anchor will not damage the liner.

A second anchor 4 can be secured to one of the rings 2 on the raft, again by means of the strap 5, and placed over the top of the pool and the anchor placed on the ground outside the pool. This will anchor the float 1 in two positions and, thereby, keep the float securely anchored in one position. This will prevent the float from moving around the pool and prevent a user from accidentally bumping his/her head into the side of the pool. Obviously placing the anchor over the top of the pool and onto the ground outside the pool is merely one position that could be used for the second anchor. The second anchor could also be placed in the pool, or in some other location.

FIG. 5 shows how the anchoring system of the present invention can be used to secure the float 1 in position in a pool 11 with a sloping floor 9'. The float 1 is anchored in the pool in the same manner as the anchor in FIG. 4. The anchor 4 will be allowed to rest on the floor 9' of the pool where the soft, malleable outer covering will conform to the bottom of the pool 9'. In order to provide a second anchoring position, a second anchor 4 is placed on the pool deck 12, and again is secured to the float 1 by the strap 5 in the same manner as the second anchor in FIG. 4. Again the soft, malleable outer covering of the anchor 4 will conform to the surface of the pool deck 12 and this will hold the anchor in position.

In addition, this type of anchoring system will prevent the float from moving around the pool and prevent a user from accidentally bumping his/her head into the side of the pool.

Although the Deluxe Float in Place Raft and the method of using the same according to the present invention has been described in the foregoing specification with considerable details, it is to be understood that modifications may be made to the invention which do not exceed the scope of the appended claims and modified forms of the present invention done by others skilled in the art to which the invention pertains will be considered infringements of this invention when those modified forms fall within the claimed scope of this invention.

We claim:

1. An anchoring system for a raft adapted to be used in a pool, said system comprising:

at least one weighted member having means for attaching a strap thereto, a strap having means at one end for securing said strap to said means on said weighted member, said strap having means on a second end for securing said strap to said raft, and wherein a first weighted member is secured around said raft, and a second weighted member is secured at one end of said raft, and wherein said raft has an upper surface, and said upper surface has at least one depression therein, and said first weighted member is secured in said depression when not in use.

2. The anchoring system as claimed in claim 1, wherein said weighted member is hollow, and said weighted member has an outer covering that is malleable.

3. The anchoring system as claimed in claim 2, wherein said weighted member is filled with a substance that adds weight to said weighted member.

4. The anchoring system as claimed in claim 3, wherein said substance is sand.

5. The anchoring system as claimed in claim 3, wherein said substance is metal pellets.

6. The anchoring system as claimed in claim 1, wherein said means at one end of said strap for securing said strap to said means on said weighted member is hook and loop fasteners.

7. The anchoring system as claimed in claim 1, wherein said means on a second end of said strap for securing said strap to said raft is hook and loop fasteners.

8. An anchoring system for a raft adapted to be used in a pool, said system comprising:

at least one weighted member having means for attaching a strap thereto, a strap having means at one end for securing said strap to said means on said weighted member, said strap having means on a second end for securing said strap to said raft, and wherein said second end of said strap has a float secured thereto, and said second end and said float are secured to said raft.

9. An anchoring system for a raft adapted to be used in a pool in combination with a raft, said combination comprising:

at least one weighted member having means for attaching a strap thereto, a strap having means at one end for securing said strap to said means on said weighted member, said strap having means on a second end for securing said strap to said raft, and wherein a first weighted member is secured around said raft, and a second weighted member is secured at one end of said raft, and wherein said first weighted member is placed on a bottom of said pool, and said second weighted member is placed outside said pool.

10. The anchoring system as claimed in claim 9, wherein said second weighted member is placed on a pool deck.

* * * * *